US005682908A

United States Patent [19]

Chou

[11] Patent Number: 5,682,908

[45] Date of Patent: Nov. 4, 1997

[54] HAIRPIN

[76] Inventor: Kuo-Hua Chou, No. 17, Alley 10, Lane 118, Su-Wei Rd., Wu-Ku Hsiang, Taipei County, Taiwan

[21] Appl. No.: 606,727

[22] Filed: Feb. 27, 1996

[51] Int. Cl.[6] ..... A45D 8/22; A45D 8/28

[52] U.S. Cl. ..... 132/278; 132/276; 132/280; 132/283; 132/284

[58] Field of Search ..... 132/273, 275, 132/276, 278, 280, 281, 283, 284; 24/150, 151, 152, 153, 154, 155, 156, 157, 158; D28/41, 42, 43

[56] References Cited

U.S. PATENT DOCUMENTS

| | | | |
|---|---|---|---|
| 220,126 | 9/1879 | Cook | 132/275 |
| 938,715 | 11/1909 | Scott | 132/284 |
| 1,434,895 | 11/1922 | Heossner | 132/273 |
| 1,781,324 | 11/1930 | Dies | 132/278 |
| 4,103,693 | 8/1978 | Reagan | 132/273 |
| 5,458,109 | 10/1995 | Tu | 132/278 |

*Primary Examiner*—Gene Mancene
*Assistant Examiner*—Philogene Pedro
*Attorney, Agent, or Firm*—Morton J. Rosenberg; David I. Klein

[57] ABSTRACT

A hairpin including a base plate, and a pin, wherein the base plate has a first row of longitudinally spaced pin holes and a second row of longitudinally spaced pin holes at two opposite ends, a first row of longitudinally spaced harness loops and a second row of longitudinally spaced harness loops alternatively arranged between the first row of longitudinally spaced pin holes and the second row of longitudinally spaced pin holes. In one embodiment, the pin has one rod section inserted through the first row of longitudinally spaced pin holes and second row of longitudinally spaced pin holes and one row of the first row of longitudinally spaced harness loops and second row of longitudinally spaced harness loops. In another embodiment, the pin has two parallel rod sections with one rod section inserted through the first row of longitudinally spaced harness loops and the other rod section through the second row of longitudinally spaced harness loops.

9 Claims, 9 Drawing Sheets

HAIRPIN

BACKGROUND OF THE INVENTION

The present invention relates to hairpins, and relates more particularly to such a hairpin which is comprised of an arched base plate having pin holes at two opposite ends and a plurality of longitudinally spaced harness loops of different heights, and a pin inserted through the pin holes and the harness loops to secure the arched base plate to the hair.

A variety of hairpins and hair clips have been disclosed for fastening the hair, and have appeared on the market. Regular hairpins commonly comprise an elongated pin body having a handle at one end. This structure of hairpin cannot firmly secure the hair in the shape of a particular style for long, and the hair tends to scatter when it is shaken. Furthermore, when a hair clip is used, the hair tends to be damaged by the clip during its installation.

SUMMARY OF THE INVENTION

The present invention has been accomplished to provide a hair pin which eliminates the aforesaid drawbacks. It is one object of the present invention to provide a hairpin which can be adjustably installed subject to the amount of hair to be fastened. It is another object of the present invention to provide a hairpin which does not damage the hair during its installation.

According to the present invention, the hairpin comprises a base plate, and a pin, wherein the base plate has a first row of longitudinally spaced pin holes and a second row of longitudinally spaced pin holes at two opposite ends, a first row of longitudinally spaced harness loops and a second row of longitudinally spaced harness loops alternatively arranged between the first row of longitudinally spaced pin holes and the second row of longitudinally spaced pin holes. In one embodiment, the pin has one rod section inserted through the first row of longitudinally spaced pin holes and second row of longitudinally spaced pin holes and one row of the first row of longitudinally spaced harness loops and second row of longitudinally spaced harness loops. In another embodiment, the pin has two parallel rod sections with one rod section inserted through the first row of longitudinally spaced harness loops and the other rod section through the second row of longitudinally spaced harness loops.

DETAILED DESCRIPTION OF THE PREFERRED EMBODIMENT

Figure 1:
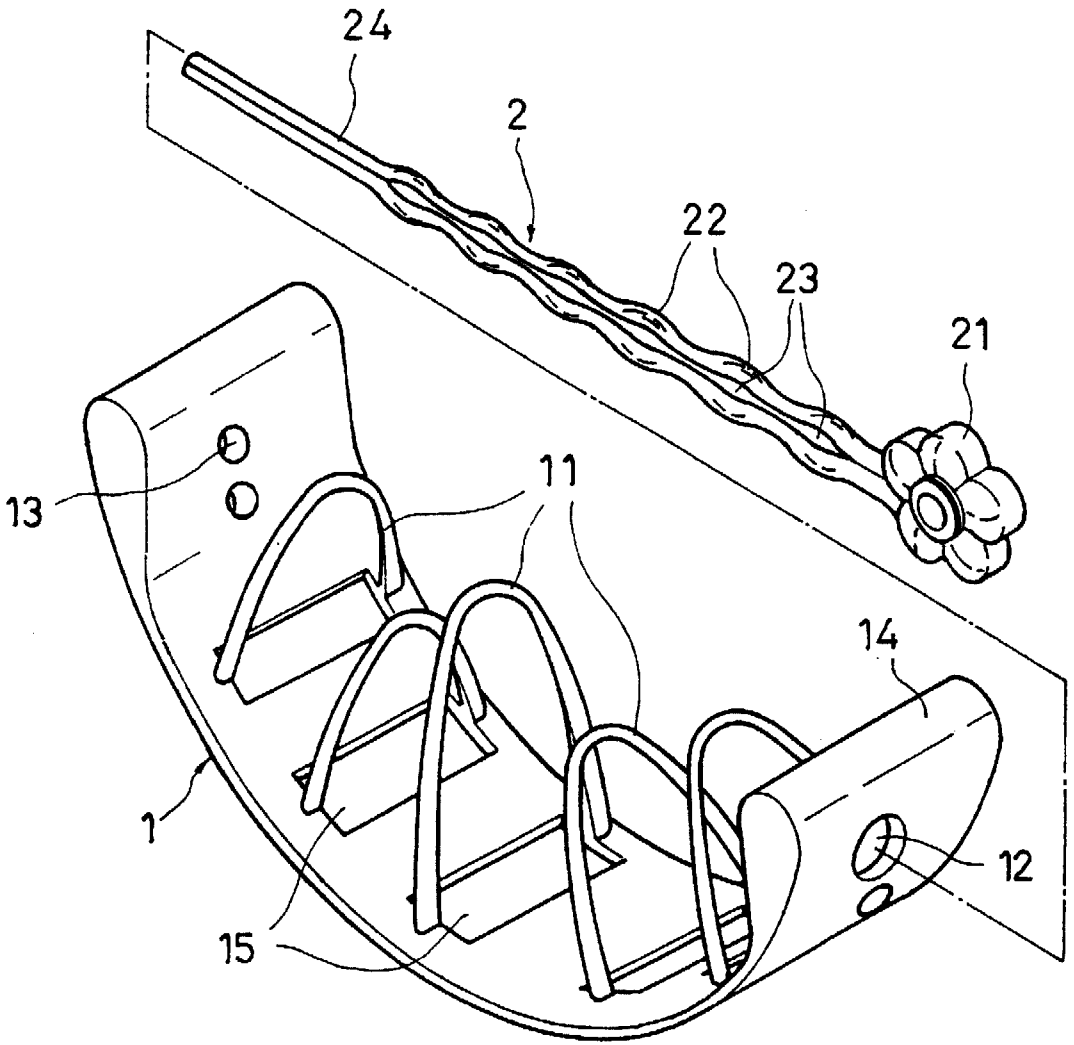
FIG. 1 is an exploded view of a hairpin according to one embodiment of the present invention.

Referring to FIG. 1, a hairpin in accordance with one embodiment of the present invention is generally comprised of a base plate 1, and a pin 2. The base plate 1 is a narrow, smoothly arched plate having two expanded, smoothly curved ends 14, a first pair of vertically spaced pin holes 12 and a second pair of vertically spaced pin holes 13 respectively disposed at two opposite locations adjacent to the smoothly curved ends 14, a plurality of ornamental openings 15 spaced between the first pair of vertically spaced pin holes 12 and the second pair of vertically spaced pin holes 13 along the length of the base plate 1, and two sets of harness loops 11 of different heights alternatively arranged between the first pair of vertically spaced pin holes 12 and the second pair of vertically spaced pin holes 13 and spaced along the length of the base plate. The pin 2 comprises a handle 21 at one end, an insertion tip 24 at an opposite end, two curved clamping portions 22 connected between the handle 21 and the insertion tip 24 and defining a longitudinal clamping gap 23 between.

Figure 2:
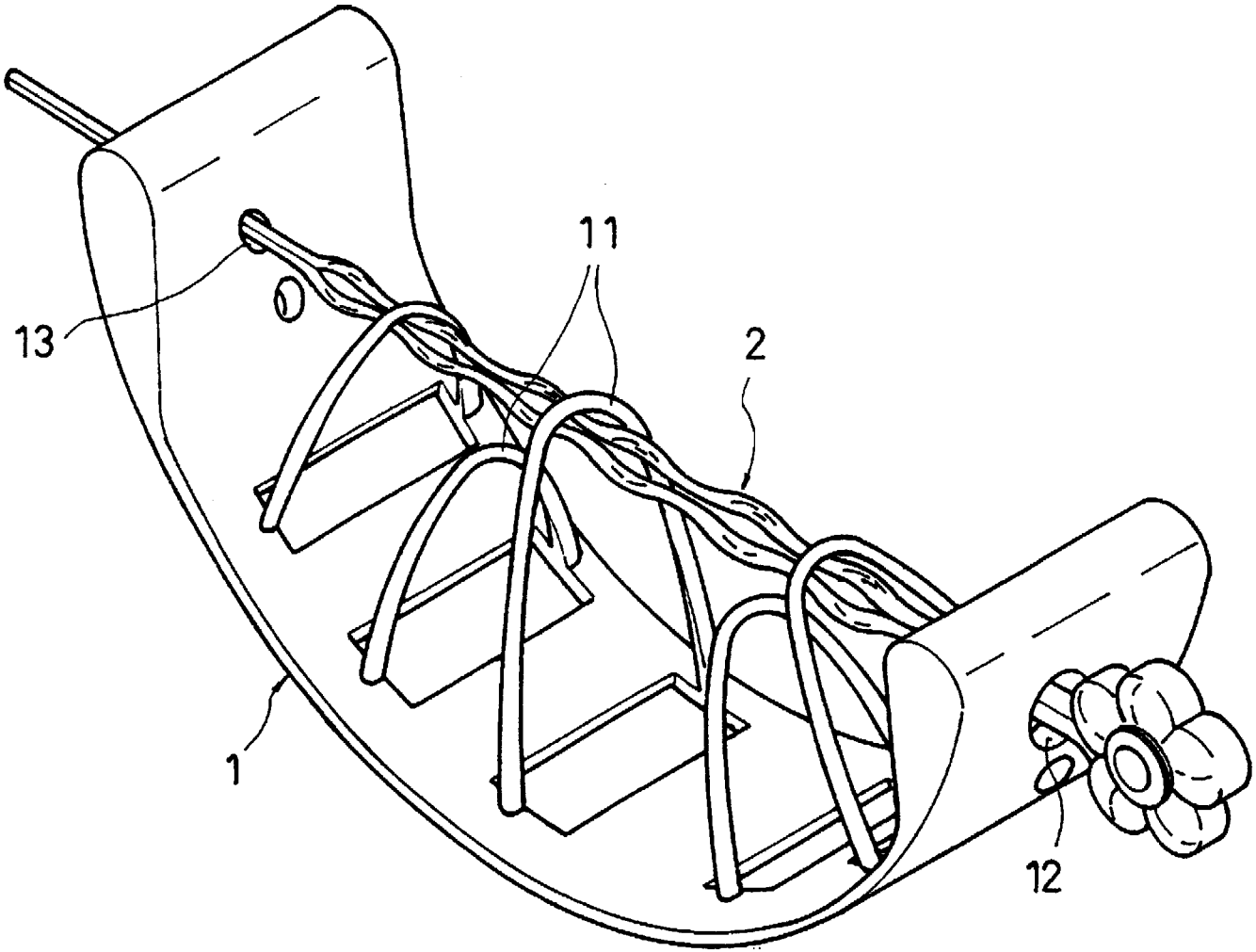
FIG. 2 shows an installation example of the hairpin shown in FIG. 1.
Figure 3:
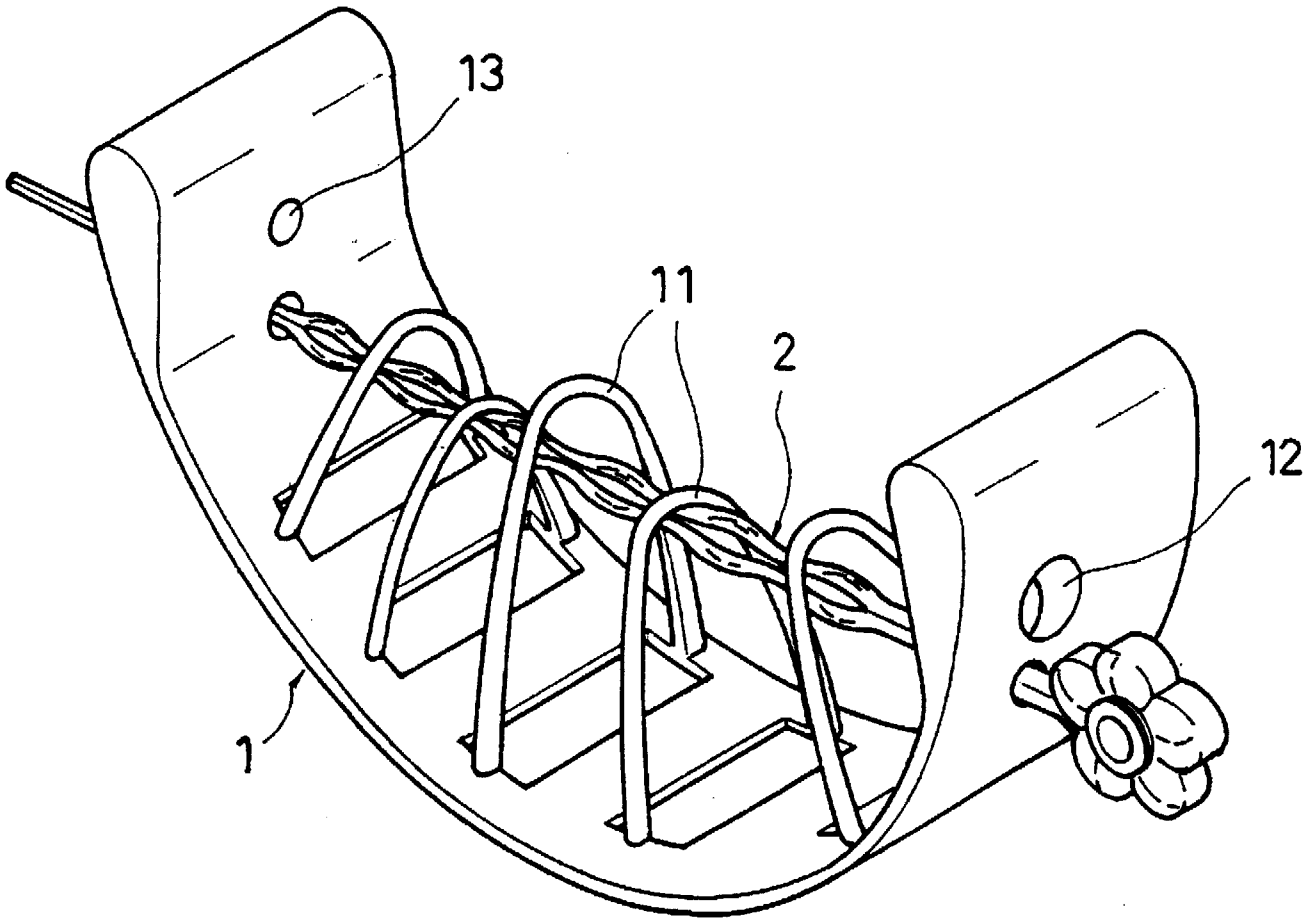
FIG. 3 shows another installation example of the hairpin shown in FIG. 1.

Referring to FIGS. 2 and 3, the pin 2 can be inserted through the higher pin holes 12, 13 and the higher harness loops 11 as shown in FIG. 2, or through the lower pin holes 12, 13 and the lower harness loops 11 as shown in FIG. 3.

Figure 4:
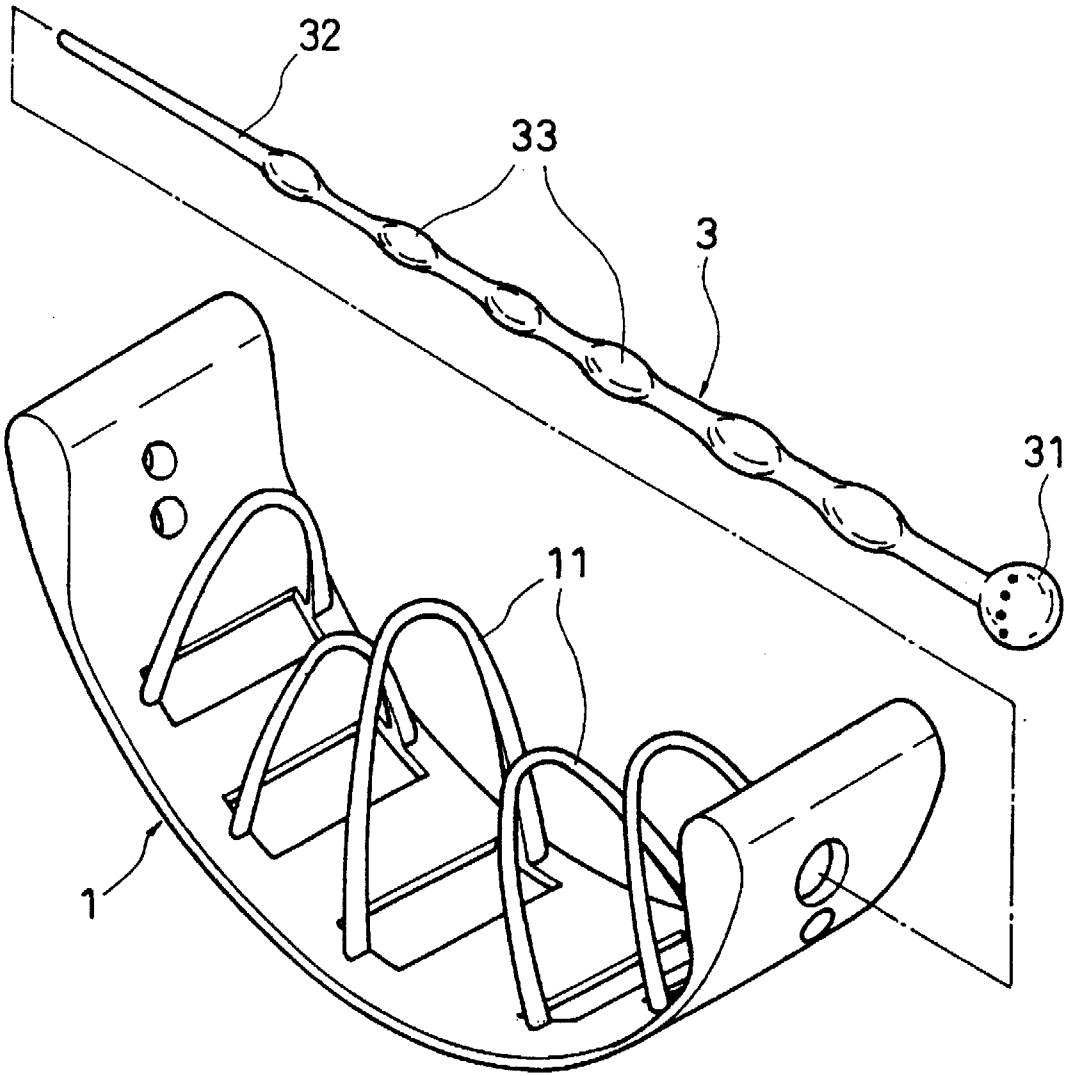
FIG. 4 is an exploded view of a hairpin according to another embodiment of the present invention.
Figure 5:
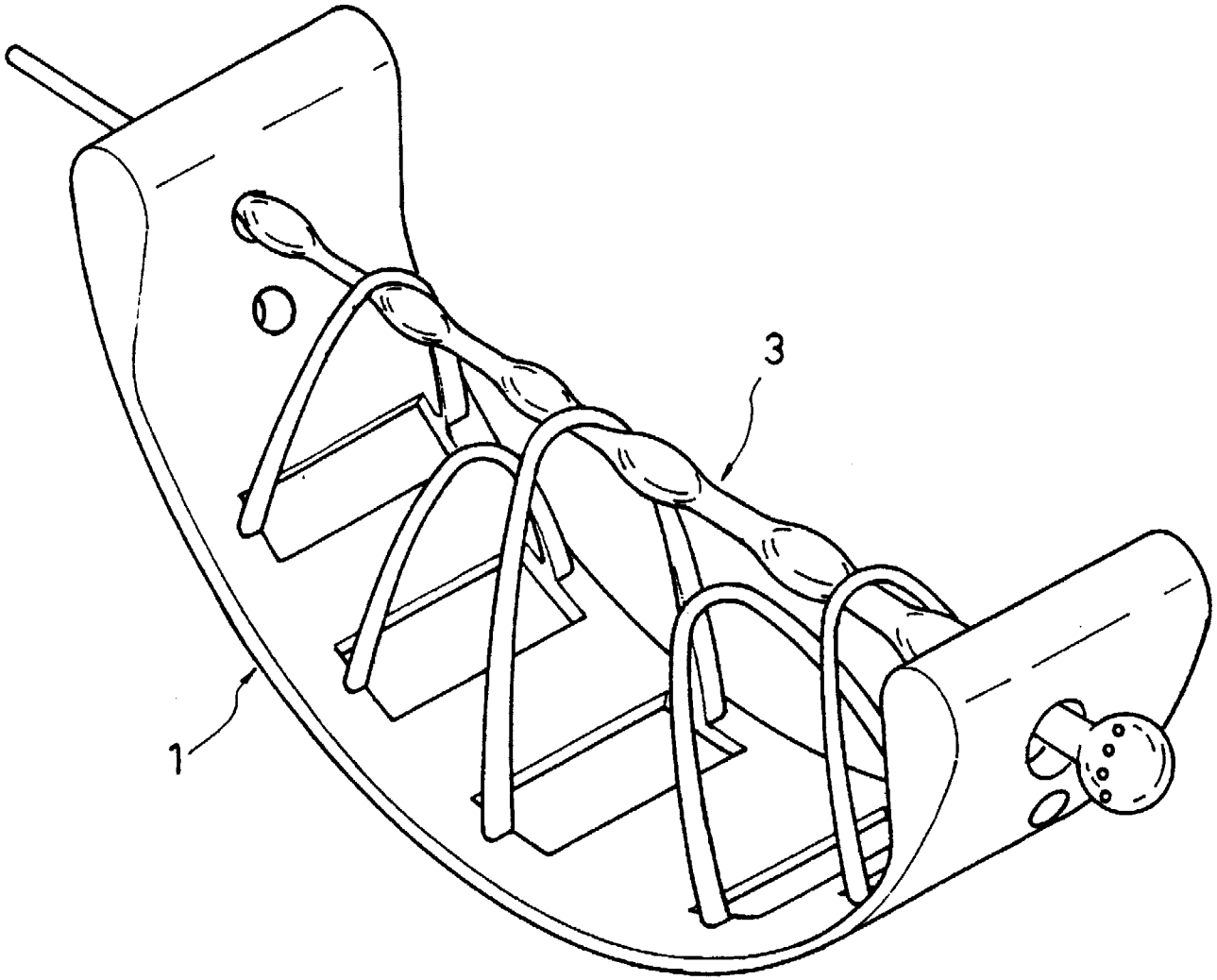
FIG. 5 is an assembly view of the hairpin shown in FIG. 4.

FIGS. 4 and 5 show an alternate form of the present invention, in which the pin, referenced by 3, is a solid rod having a rounded head 31 at one end for the holding of the hand, an insertion tip 32 at an opposite end for insertion into the pin holes 12, 13 of the base plate 1, and a plurality of knots 33 spaced between the rounded head 31 and the insertion tip 32 for the positioning of the harness loops 11 on the pin 3.

Figure 6:
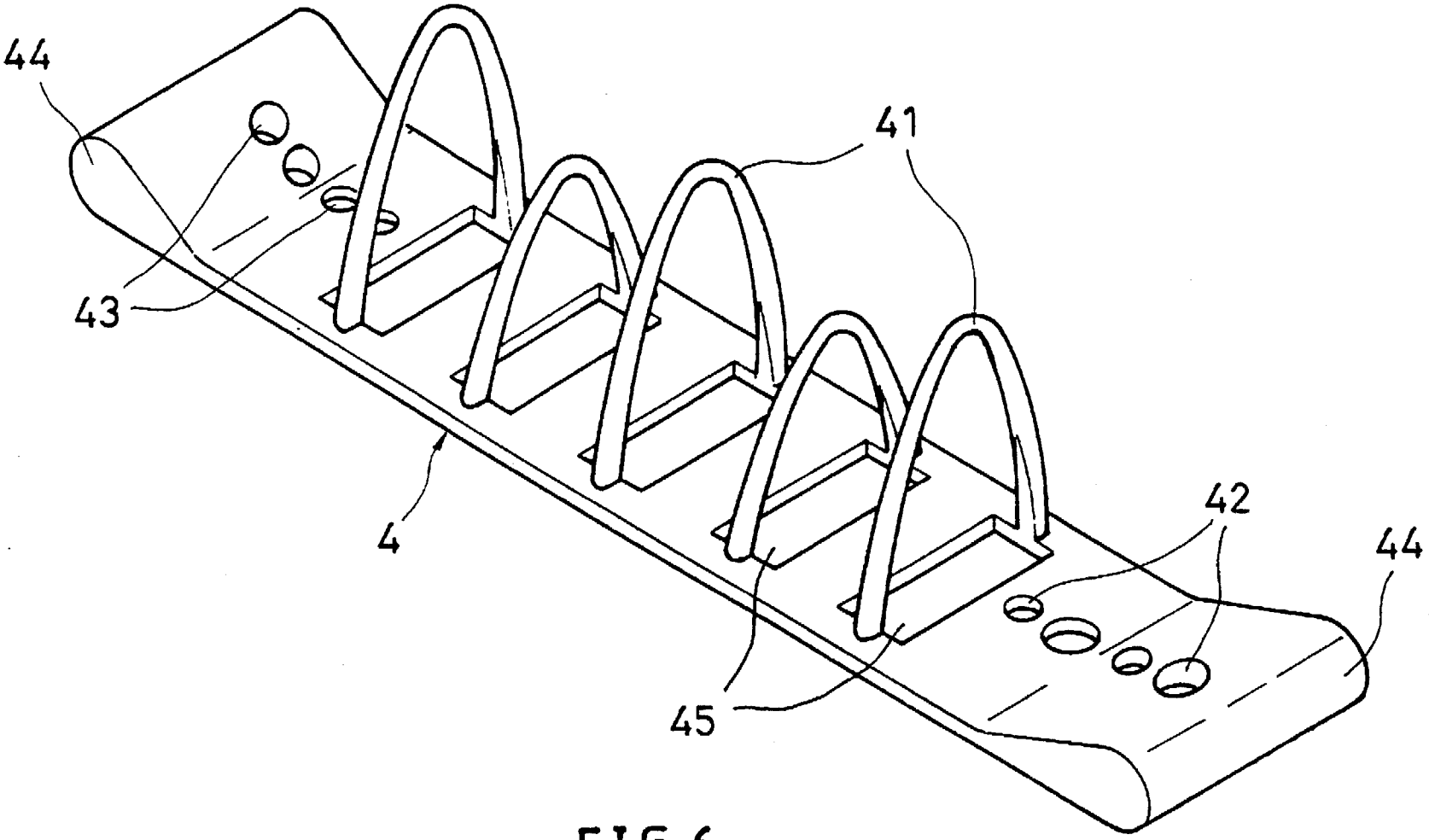
FIG. 6 shows an alternate form of the base plate according to the present invention.
Figure 7:
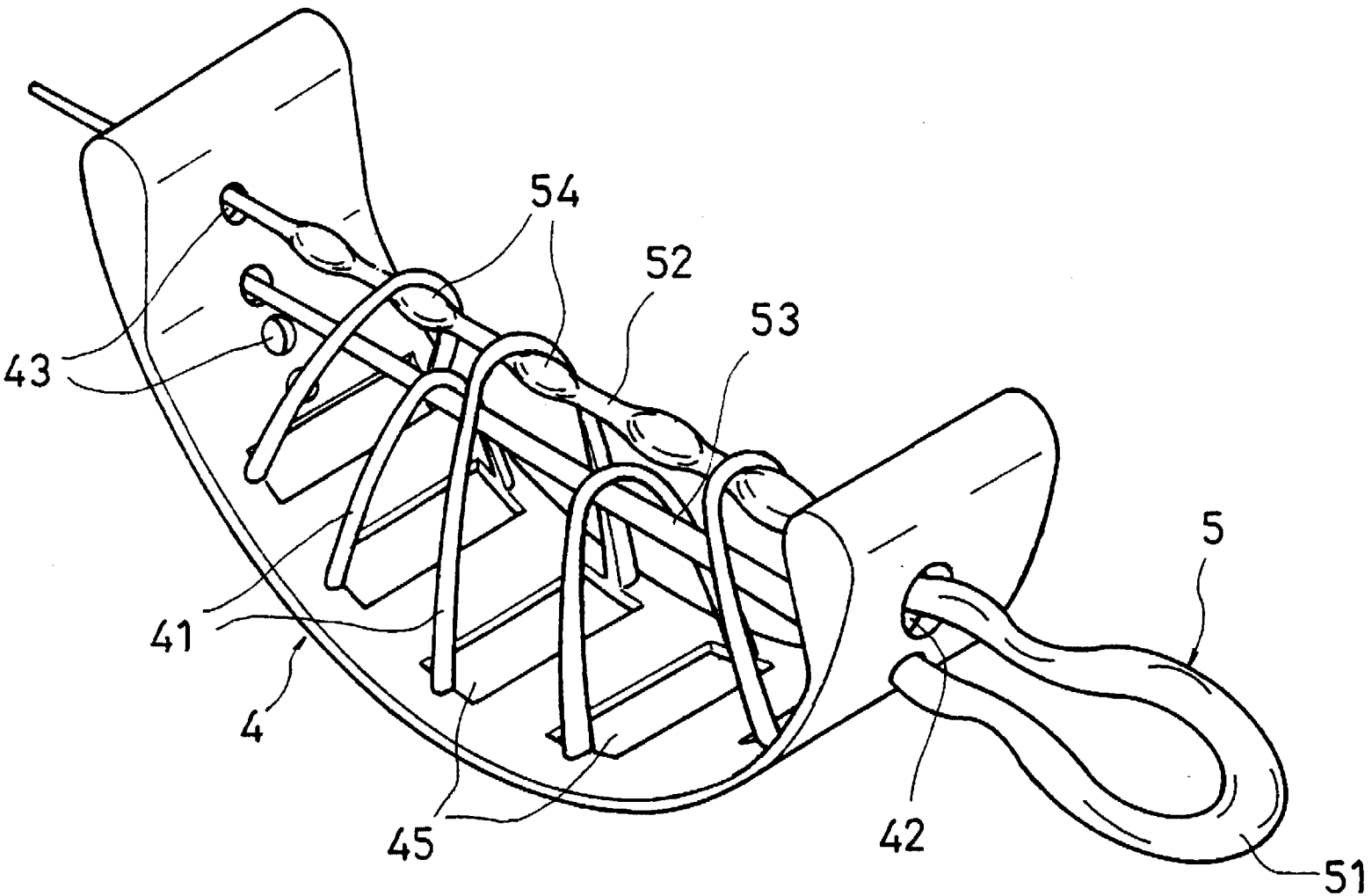
FIG. 7 shows a pin of two rod sections fastened to the base plate shown in FIG. 6.
Figure 8:
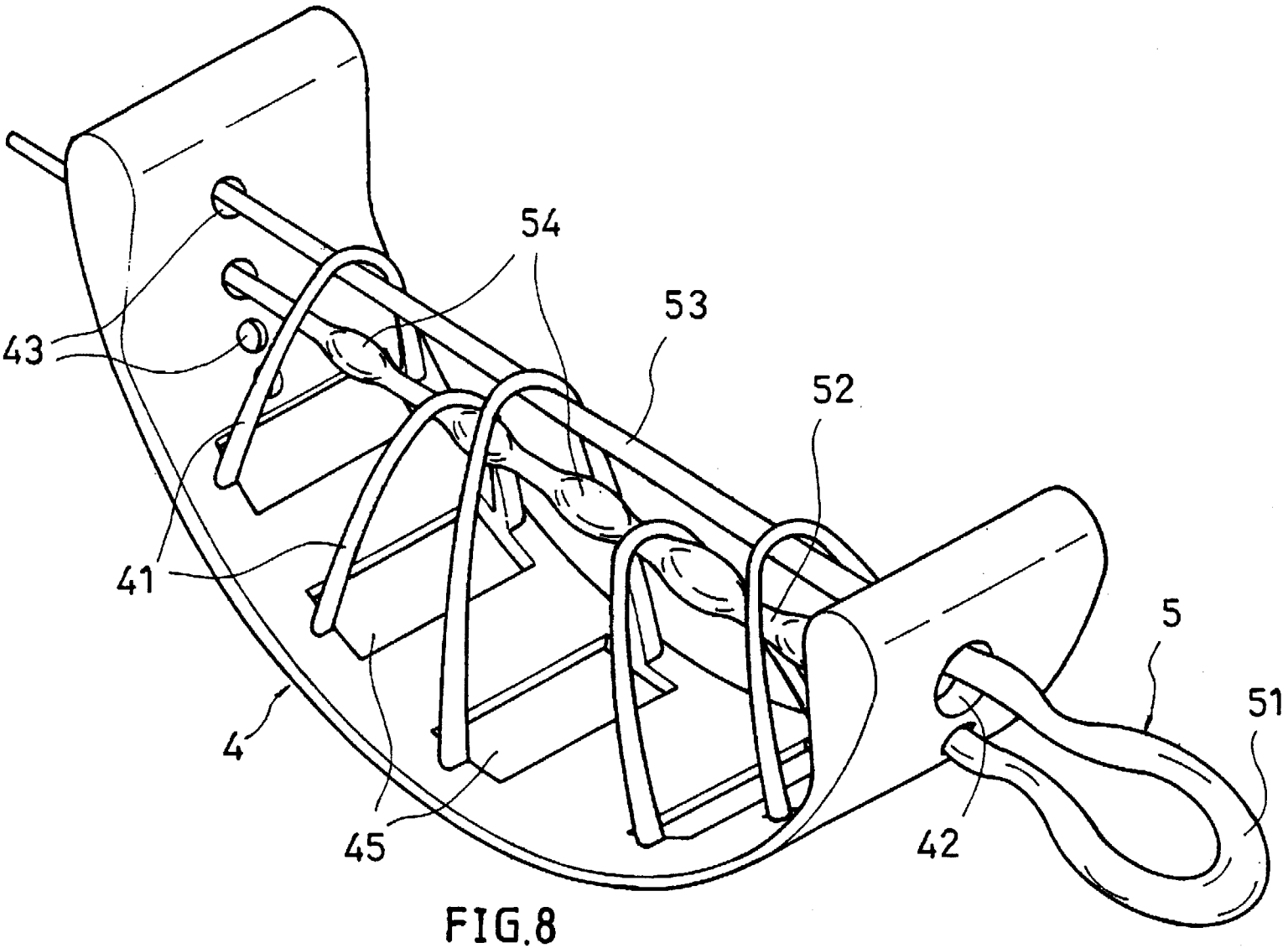
FIG. 8 shows an alternate arrangement of the hairpin shown in FIG. 7.

FIGS. 6, 7, and 8 show another alternate form of the present invention, in which the base plate, referenced by 4, is long, narrow, flexible plate having two expanded, smoothly curved ends 44, two rows of longitudinally spaced pin holes 42, 43 at two opposite ends adjacent to the curved ends 44, a plurality of ornamental openings 45 longitudinally spaced between the two rows of longitudinally spaced pin holes 42, 43, and two sets of harness loops 41 of different heights alternatively arranged between the two rows of longitudinally spaced pin holes 42, 43 and spaced along the length of the base plate 4; the pin, referenced by 5, comprises a first rod section 52 having a plurality of longitudinally spaced knots 54, a second rod section 53 disposed in parallel to the first rod section 52, and a handhold portion 51 connected between the first rod section 52 and the second rod section 53 at one end. When in use, the curved ends 44 are turned inwards toward each other to deform the base plate 4, and then the first rod section 52 and second rod section 53 are inserted through the pin holes 42, 43 and the harness loops 41 at different elevations. FIG. 7 shows the first rod section 52 inserted through the higher harness loops 41 and the second rod section 53 inserted through the lower harness loops 41. FIG. 8 shows the second rod section 53 inserted through the higher harness loops 41 and the first rod section 52 inserted through the lower harness loops 41.

Figure 9:
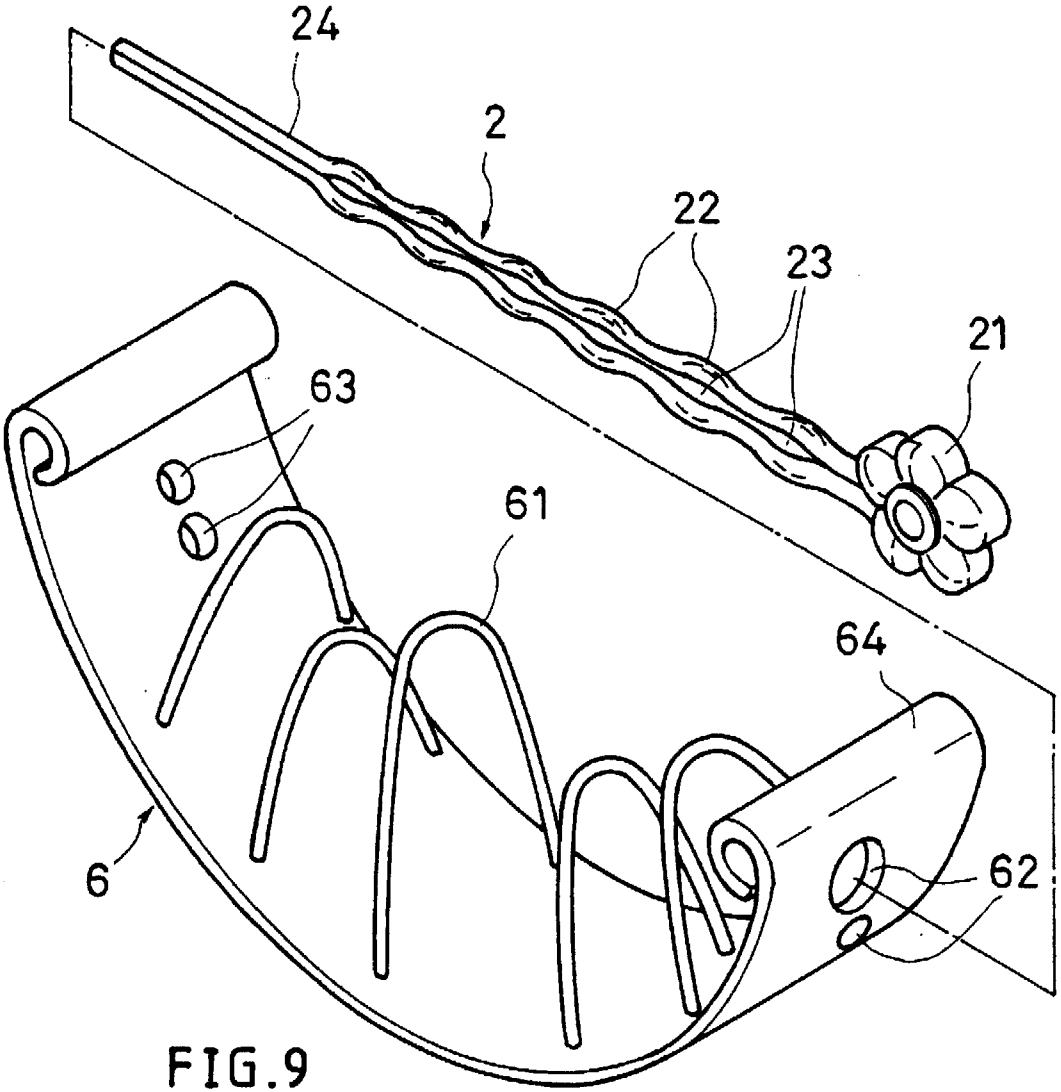
FIG. 9 shows still another alternate form of the present invention.

FIG. 9 shows still another alternate form of the present invention in which the base plate 6 has two opposite ends 64 curled up, two rows of longitudinally spaced pin holes 62, 63 respectively disposed near the curled ends 64 for the insertion of the pin 2, and two sets of harness loops 61 of different heights alternatively arranged between the two rows of longitudinally spaced pin holes 62, 63.

It will be understood that the drawings are designed for purposes of illustration only, and are not intended as a definition of the limits and scope of the invention disclosed.

What the invention claimed is:

1. A hairpin assembly comprising:

(a) a base plate having a pair of distal end portions and an intermediate portion extending in a longitudinal direction therebetween, said base plate having formed at each of said end portions at least a first pin hole and at least a second pin hole, said first pin holes of said end portions being adapted to define a first pin hole row, said second pin holes of said end portions being adapted to define a second pin hole row, said intermediate portion having formed thereon a plurality of longitudinally spaced first harness loops and a plurality of longitudinally spaced second harness loops, each of said second harness loops being disposed between a pair of said first harness loops; and, (b) a pin for engaging said base plate, said pin having a handle portion and an elongate engagement portion extending therefrom, said engagement portion being adapted for insert through at least one of said first and second pin hole rows and through at least one of said first and second harness loops.

2. The hairpin as recited in claim 1 wherein said first and second pin hole rows are defined to extend in spaced relation to said intermediate portion of said base plate, said first pin hole row being spaced farther from said intermediate portion than said second pin hole row.

3. The hairpin as recited in claim 1 wherein said intermediate portion of said base plate has formed therein a plurality of ornamental openings.

4. The hairpin as recited in claim 1 wherein said base plate is formed of a flexible material.

5. The hairpin as recited in claim 4 wherein said base plate is resiliently biased to retain a substantially flat, planar configuration.

6. The hairpin as recited in claim 1 wherein said engagement portion of said pin includes longitudinally extended first and second rod sections adapted for concurrent respective insert through at least one of said first harness loops and at least one of said second harness loops.

7. The hairpin as recited in claim 1 wherein said engagement portion of said pin terminates in an insertion tip.

8. The hairpin as recited in claim 7 wherein said engagement portion of said pin includes a pair of longitudinally extended clamping portions separated by a clamping gap, said clamping portions merging at said insertion tip.

9. The hairpin as recited in claim 7 wherein said engagement portion of said pin is characterized by an undulating contour defining a plurality of longitudinally spaced knots.

* * * * *